US009697759B2

(12) United States Patent
Yamashita et al.

(10) Patent No.: US 9,697,759 B2
(45) Date of Patent: Jul. 4, 2017

(54) DRIVE DEVICE, NON-TRANSITORY COMPUTER READABLE MEDIUM, PROCESS FOR DISPLAY MEDIUM AND DISPLAY APPARATUS

(71) Applicant: FUJI XEROX CO., LTD., Tokyo (JP)

(72) Inventors: Takamaro Yamashita, Kanagawa (JP); Hideo Kobayashi, Kanagawa (JP); Tsutomu Ishii, Kanagawa (JP); Masami Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 207 days.

(21) Appl. No.: 14/274,981

(22) Filed: May 12, 2014

(65) Prior Publication Data

US 2015/0124010 A1 May 7, 2015

(30) Foreign Application Priority Data

Oct. 8, 2013 (JP) ..... 2013-211049

(51) Int. Cl.

| | |
|---|---|
| ***G09G 5/02*** | (2006.01) |
| ***G09G 5/00*** | (2006.01) |
| ***G09G 3/20*** | (2006.01) |
| ***G09G 3/34*** | (2006.01) |

(52) U.S. Cl.

CPC ..... *G09G 3/2003* (2013.01); *G09G 3/344* (2013.01); *G09G 2300/0473* (2013.01); *G09G 2320/0242* (2013.01); *G09G 2320/066* (2013.01); *G09G 2320/0666* (2013.01); *G09G 2320/0673* (2013.01); *G09G 2360/145* (2013.01)

(58) Field of Classification Search

None

See application file for complete search history.

(56) References Cited

U.S. PATENT DOCUMENTS

| | | | | |
|---|---|---|---|---|
| 7,109,984 | B2 | 9/2006 | Moon | |
| 7,737,963 | B2 | 6/2010 | Moon | |
| 2003/0058235 | A1 | 3/2003 | Moon | |
| 2005/0017990 | A1 * | 1/2005 | Yoshida | G09G 3/3406 345/690 |
| 2006/0274006 | A1 | 12/2006 | Moon | |
| 2009/0040297 | A1 * | 2/2009 | Harada | G02F 1/133509 348/54 |
| 2011/0032227 | A1 | 2/2011 | Miyaguchi | |

(Continued)

FOREIGN PATENT DOCUMENTS

| | | |
|---|---|---|
| JP | 2003-186455 | 7/2003 |
| JP | 2009-251066 | 10/2009 |

(Continued)

OTHER PUBLICATIONS

Abstract and machine translation of JP 2009-251066.
Abstract and machine translation of JP 2011-248060.

*Primary Examiner* — Christopher R Lamb
(74) *Attorney, Agent, or Firm* — Fildes & Outland, P.C.

(57) ABSTRACT

A drive device for a display medium includes a control unit that controls density of a display color of a predetermined range in which glare may likely occur, of display colors of an image displayed on a reflective type display medium, based on brightness information indicating brightness of irradiation beams irradiated on the display medium so that occurrence of the glare as to the display color of the predetermined range can be suppressed.

2 Claims, 10 Drawing Sheets

(56) References Cited

U.S. PATENT DOCUMENTS

| | | | | |
|---|---|---|---|---|
| 2011/0122109 | A1* | 5/2011 | Nose | G09G 3/3629<br>345/207 |
| 2014/0218345 | A1* | 8/2014 | Matsuura | G09G 3/3426<br>345/207 |

FOREIGN PATENT DOCUMENTS

| | | |
|---|---|---|
| JP | 2011-53662 | 3/2011 |
| JP | 2011-248060 | 12/2011 |

* cited by examiner

DRIVE DEVICE, NON-TRANSITORY COMPUTER READABLE MEDIUM, PROCESS FOR DISPLAY MEDIUM AND DISPLAY APPARATUS

CROSS-REFERENCE TO RELATED APPLICATIONS

This application is based on and claims priority under 35 USC 119 from Japanese Patent Application No. 2013-211049 filed on Oct. 8, 2013.

BACKGROUND

Technical Field

The present invention relates to a drive device for a display medium, a non-transitory computer readable medium storing a program causing a computer to execute a process for a display medium, a process for display medium and a display apparatus.

SUMMARY

According to an aspect of the invention, there is provided a drive device for a display medium, comprises: a control unit which controls density of a display color of a predetermined range in which glare may likely occur, of display colors of an image displayed on a reflective type display medium, based on brightness information indicating brightness of irradiation beams irradiated on the display medium so that occurrence of the glare as to the display color of the predetermined range can be suppressed.

BRIEF DESCRIPTION OF THE DRAWINGS

Exemplary embodiments of the present invention will be described in detail based on the following figures, wherein.

REFERENCE SIGNS LIST

Figure 1:
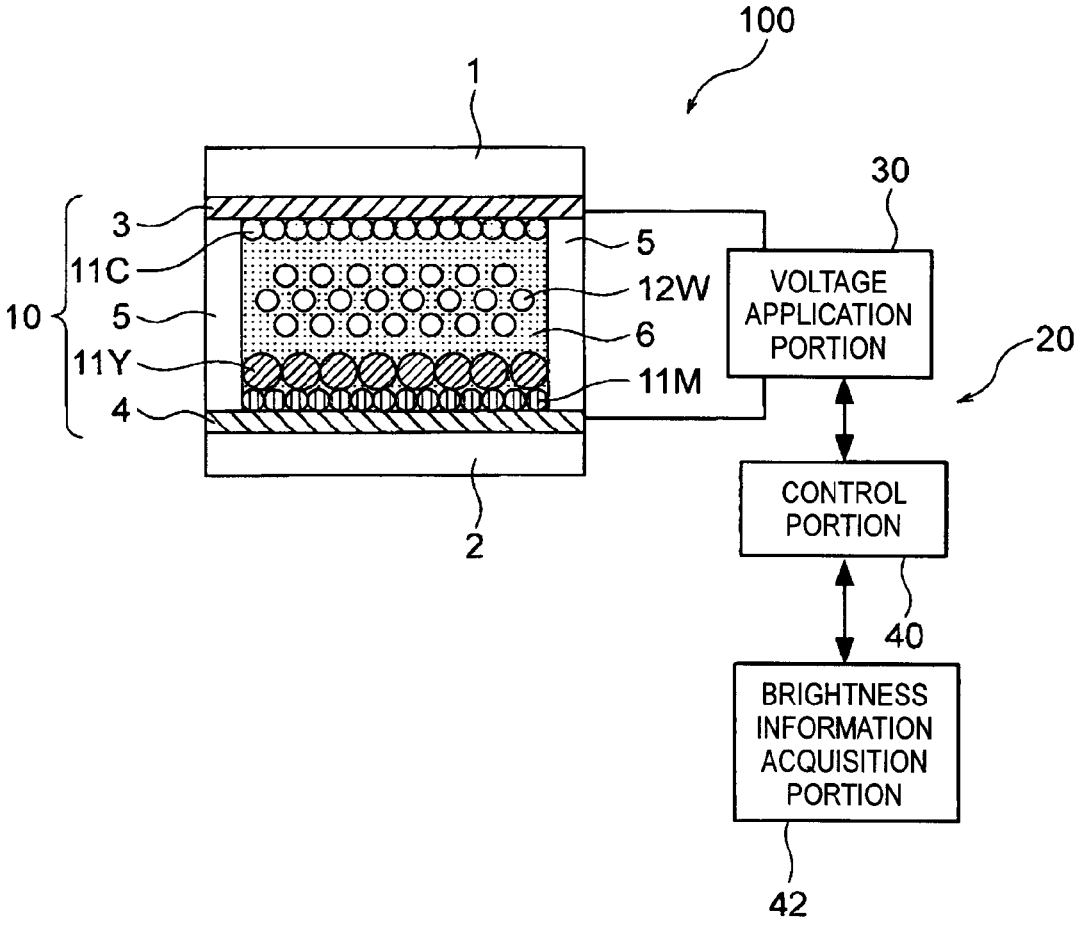
FIG. 1 is a schematic view of the configuration of a display apparatus.

1 display substrate
2 back substrate
3 display-side electrode
4 back-side electrode
5 gap member
6 dispersion medium
10 display medium
11Y yellow colored particle group
11C cyan colored particle group
11M magenta colored particle group
12W white colored particle group
20 drive device
30 voltage application portion
40 control portion
42 brightness information acquisition portion
100 display apparatus

DETAILED DESCRIPTION (First Exemplary Embodiment)

FIG. 1 is a view schematically showing a display apparatus 100 according to a first exemplary embodiment. The display apparatus 100 is provided with a reflective type display medium 10 and a drive device 20 for driving the display medium 10. Here, the reflective type display, medium 10 means a display medium of a type which reflects light emitted from the sun or a lighting device such as a fluorescent lamp to display an image. Examples of the display medium 10 include a display medium using a so-called electrophoretic method, a display medium using cholesteric liquid crystal, etc. Although the exemplary embodiment will be described in the case where an electrophoretic type display medium is used as an example of the reflective type display medium 10, the invention is not limited thereto. Any display medium of another type may be used as long as it is a reflective type display medium.

The drive device 20 is provided with a voltage application portion 30, a control portion 40, and a brightness information acquisition portion 42. The voltage application portion 30 applies a voltage between a display-side electrode 3 and a back-side electrode 4 of the display medium 10. The control portion 40 controls the voltage application portion 30 in accordance with color information of an image displayed on the display medium 10. The brightness information acquisition portion 42 acquires brightness information indicating brightness of irradiation beams irradiated on the display medium 10.

In the display medium 10, a display substrate 1 having translucency and used as an image display surface, and a back substrate 2 used as a non-display surface are disposed to be opposed to each other at a distance from each other. In addition, a predetermined distance between the display substrate 1 and the back substrate 2 is kept, and a gap member 5 partitioning a space between the substrates into a plurality of cells is provided so as to prevent in-plane particle groups of the display medium from leaning. Incidentally, one cell is shown in FIG. 1 for the sake of simplifying explanation. In addition, configuration may be made so that both the display substrate 1 and the back substrate 2 can have translucency.

In addition, in the exemplary embodiment, the display-side electrode 3 is a common electrode formed on the whole surface of the display substrate 1 and the back-side electrode 4 is constituted by a plurality of isolated electrodes to thereby form an electrode configuration supporting so-called active matrix driving, by way of example. In addition, although pixels are formed correspondingly to the plurality of isolated electrodes respectively, the pixels and the cells may or may not correspond to each other.

For example, a transparent dispersion medium 6 made of an insulating liquid, and a cyan colored particle group 11C (hereinafter also referred to as cyan particles C), a magenta colored particle group 11M (hereinafter also referred to as magenta particles M), a yellow colored particle group 11Y (hereinafter referred to as yellow particles Y) and a white colored particle group 12W (hereinafter also referred to as white particles W) which are dispersed in the dispersion medium 6 are sealed inside the cell. Although the exemplary embodiment will be described in the case where three kinds of (i.e. cyan, magenta and yellow) colored particle groups are provided as the colored particle groups moving between the substrates, the kinds of colors are not limited thereto. In addition, the number of kinds of colored particle groups moving between the substrates may be two or may be four or more.

Figure 2:
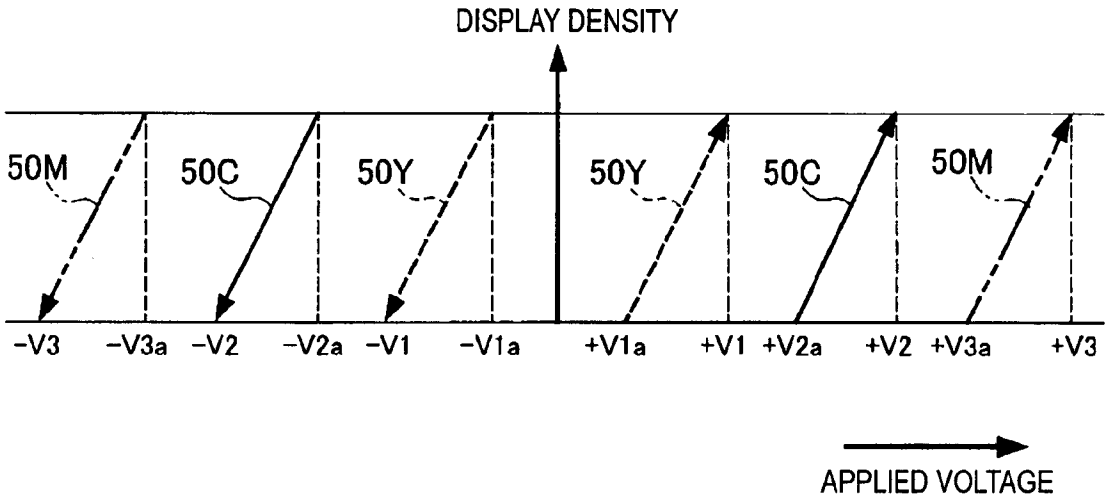
FIG. 2 is a view showing voltage application characteristic of immigrating particles.

FIG. 2 shows characteristic of an applied voltage required for moving the yellow particles Y, the magenta particles M and the cyan particles C which are all positively charged to the display substrate 1 side or the back substrate 2 side, by way of example. In FIG. 2, voltage-display density characteristic of the yellow particles Y is indicated as characteristic 50Y, voltage-display density characteristic of the magenta particles M is indicated as characteristic 50M, and voltage-display density characteristic of the cyan particles C is indicated as characteristic 50C. In addition, FIG. 2 shows the relation between the voltage applied to the back-side electrode 4 while the display-side electrode 3 is grounded (0V) and the display density based on each particle group.

As shown in FIG. 2, a movement starting voltage (threshold voltage) for generating an electric field in which the yellow particles Y on the back substrate 2 side start to move toward the display substrate 1 side is +V1a, and a movement starting voltage for generating an electric field in which the yellow particles Y on the display substrate 1 side start to move toward the back substrate 2 side is −V1a. Accordingly, when a voltage not lower than +V1a is applied, the yellow particles Y on the back substrate 2 side move to the display substrate 1 side. When a voltage not higher than −V1a is applied, the yellow particles Y on the display substrate 1 side move to the back substrate 2 side. In addition, a threshold voltage for generating an electric field in which all the yellow particles Y on the back substrate 2 side move to the display substrate 1 side is +V1, and a threshold voltage for generating an electric field in which all the yellow particles Y on the display substrate 1 side move to the back substrate 2 side is −V1.

For example, in the case where the pulse width (voltage application time) of the applied voltage is set to be constant, the particle quantity of yellow particles Y moved from the back substrate 2 side to the display substrate 1 side can be controlled (voltage value modulation) by changing the voltage value of the applied voltage. For example, when the pulse width of the applied voltage is set to be constant and the voltage value is set as a desired voltage value not lower than +V1a for controlling the particle quantity of yellow particles Y moved from the back substrate 2 side to the display substrate 1 side, the yellow particles Y having a particle quantity corresponding to the voltage value are moved to the display substrate 1 side. In this manner, gradation display of the yellow particles Y can be controlled. The same rule applies to the particle quantity in the case where the yellow particles Y on the display substrate 1 side are moved to the back substrate 2 side.

Incidentally, configuration may be made so that the voltage value of the applied voltage can be set to be constant and the pulse width can be changed to control the particle quantity of moving particles to thereby control the gradation display (pulse width modulation). For example, when the voltage value of the applied voltage is set as a predetermined voltage value not lower than +V1a for controlling the particle quantity of yellow particles Y moved from the back substrate 2 side to the display substrate 1 side, the particle quantity of yellow particles Y moving to the display substrate 1 side is larger as the pulse width of the voltage is longer. Accordingly, when the voltage value is fixed and the pulse width is set as a pulse width having a length corresponding to a gradation, the gradation display of the yellow particles Y can be controlled. The exemplary embodiment will be described in the case where the particle quantity of moving particles is controlled by voltage value modulation by way of example. Incidentally, the same rule will also apply to the cyan particles C and the magenta particles M which will be described as follows.

As shown in FIG. 2, a movement starting voltage for generating an electric field in which the cyan particles C on the back substrate 2 side start to move toward the display substrate 1 side is +V2a, and a movement starting voltage for generating an electric field in which the cyan particles C on the display substrate 1 side start to move toward the back substrate 2 side is −V2a. Accordingly, when a voltage not lower than +V2a is applied, the cyan particles C on the back substrate 2 side move to the display substrate 1 side. When a voltage not higher than −V2a is applied, the cyan particles C on the display substrate 1 side move to the back substrate 2 side. In addition, a threshold voltage for generating an electric field in which all the cyan particles C on the back substrate 2 side move to the display substrate 1 side is +V2, and a threshold voltage for generating an electric field in which all the cyan particles C on the display substrate 1 side move to the back substrate 2 side is −V2.

Similarly to the aforementioned yellow particles Y, the particle quantity of cyan particles C moved from the back substrate 2 side to the display substrate 1 side can be controlled by the voltage value modulation or the pulse width modulation. For example, assume that the particle quantity of cyan particles C moved from the back substrate 2 side to the display substrate 1 side is controlled by the voltage value modulation. When the pulse width of the applied voltage is set to be constant and the voltage value is set as a desired voltage value not lower than +V2a in this case, the cyan particles C having a particle quantity corresponding to the voltage value are moved to the display substrate 1 side. In this manner, gradation display of the cyan particles C can be controlled.

As shown in FIG. 2, the relation $|V1|<|V2|$ is established. The absolute value of the voltage value of the threshold voltage for the cyan particles C is larger than the absolute value of the voltage value of the threshold voltage for the yellow particles Y.

As shown in FIG. 2, a movement starting voltage for generating an electric field in which the magenta particles M on the back substrate 2 side start to move toward the display substrate 1 side is +V3a, and a movement starting voltage for generating an electric field in which the magenta particles M on the display substrate 1 side start to move toward the back substrate 2 side is −V3a. Accordingly, when a voltage not lower than +V3a is applied, the magenta particles M on the back substrate 2 side move to the display substrate 1 side. When a voltage not higher than −V3a is applied, the magenta particles M on the display substrate 1 side move to the back substrate 2 side. In addition, a threshold voltage for generating an electric field in which all the magenta particles M on the back substrate 2 side move to the display substrate 1 side is +V3, and a threshold voltage for generating an electric field in which all the magenta particles M on the display substrate 1 side move to the back substrate 2 side is −V3.

Similarly to the aforementioned yellow particles Y and the aforementioned cyan particles C, the particle quantity of magenta particles M moved from the back substrate 2 side to the display substrate 1 side can be controlled by the voltage value modulation or the pulse width modulation. For example, assume that the particle quantity of magenta particles M moved from the back substrate 2 side to the display substrate 1 side is controlled by the voltage value modulation. When the pulse width of the applied voltage is set to be constant and the voltage value is set as a desired voltage value not lower than +V3a in this case, the magenta particles M having a particle quantity corresponding to the voltage value are moved to the display substrate 1 side. In this manner, gradation display of the magenta particles M can be controlled.

As shown in FIG. 2, the relation $|V2|<|V3|$ is established. The absolute value of the voltage value of the threshold voltage for the magenta particles M is larger than the absolute value of the voltage value of the threshold voltage for the cyan particles C.

Figure 3:
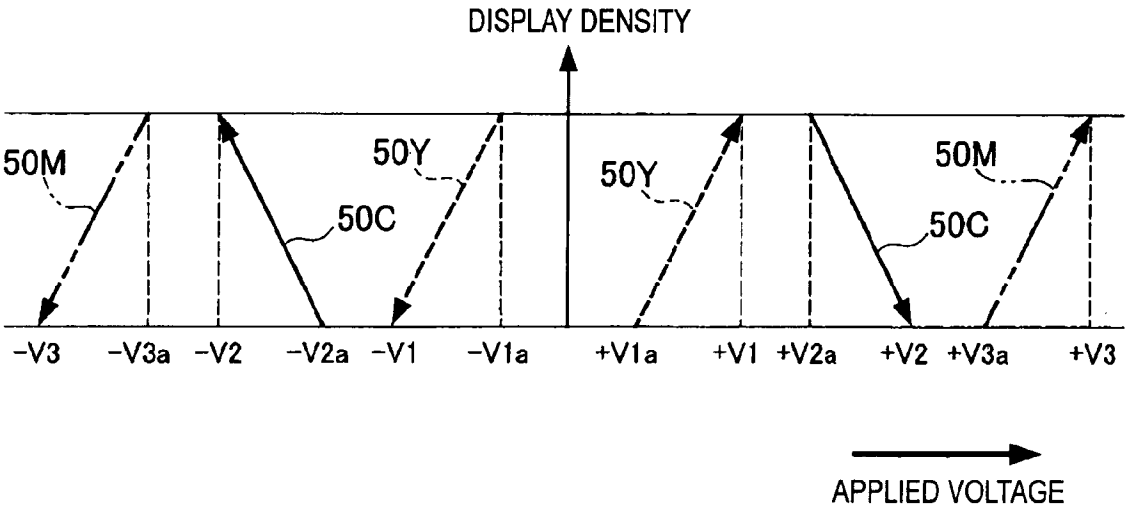
FIG. 3 is a view showing another example of the voltage application characteristic of the immigrating particles.

Although the exemplary embodiment has been described in the case where all the yellow particles Y, the cyan particles C and the magenta particles M are charged positively, the charging polarity is not limited thereto. For example, the yellow particles Y and the magenta particles M may be charged positively and the cyan particles C may be charged negatively. In this case, the relation between the applied voltage and the display density becomes a relation shown in FIG. 3.

In addition, according to the exemplary embodiment, for example, each of the cyan particle C and the magenta particle M has a particle diameter which is smaller than the particle diameter of the yellow particle Y and which is small enough to pass through a gap between adjacent ones of some aggregated yellow particles Y when the yellow particles Y are deposited and aggregated on any one of the substrates. However, the invention is not limited thereto. The particle diameter of each of the cyan particle C and the magenta particle M may be set suitably in accordance with the charging polarity and responsiveness, etc. of the particle.

On the other hand, the white particles W are particles each with a smaller electric charge amount or with no electric charge amount, in comparison with the colored particles of the yellow particles Y, the magenta particles M and the cyan particles C. Therefore, even when the voltage by which the colored particles are made to migrate to one of the display substrate 1 and the back substrate 2 is applied between the display-side electrode 3 and the back-side electrode 4, the migration speed of the white particles W is slower than the migration speed of each of the colored particles so that the white particles W are not deposited on any one of the substrates but float in the dispersion medium 6. Therefore, when all the colored particles of the yellow particles Y, the magenta particles M and the cyan particles C are moved to the back substrate 2 side, the whole surface turns into white display. That is, the display medium 10 is a display medium whose base is white in color. Incidentally, the color of the base is not limited to white. That is, particles having another color than white may be used as the particles floating in the dispersion medium 6. In addition, a display medium having a configuration in which floating particles are not used may be used.

The drive device 20 (the voltage application portion 30 and the control portion 40) applies a voltage corresponding to color information of an image to be displayed, between the display-side electrode 3 and the back-side electrode 4 to move colored particles having a quantity corresponding to the color information. Thus, the image is displayed on the display medium 10.

The voltage application portion 30 is a voltage application device for applying a voltage to the display-side electrode 3 and the back-side electrode 4. The voltage application portion 30 is electrically connected to the display-side electrode 3 and the back-side electrode 4 and connected to the control portion 40. The voltage application portion 30 applies a voltage to the display-side electrode 3 and the back-side electrode 4 in accordance with an instruction issued from the control portion 40.

Figure 4:
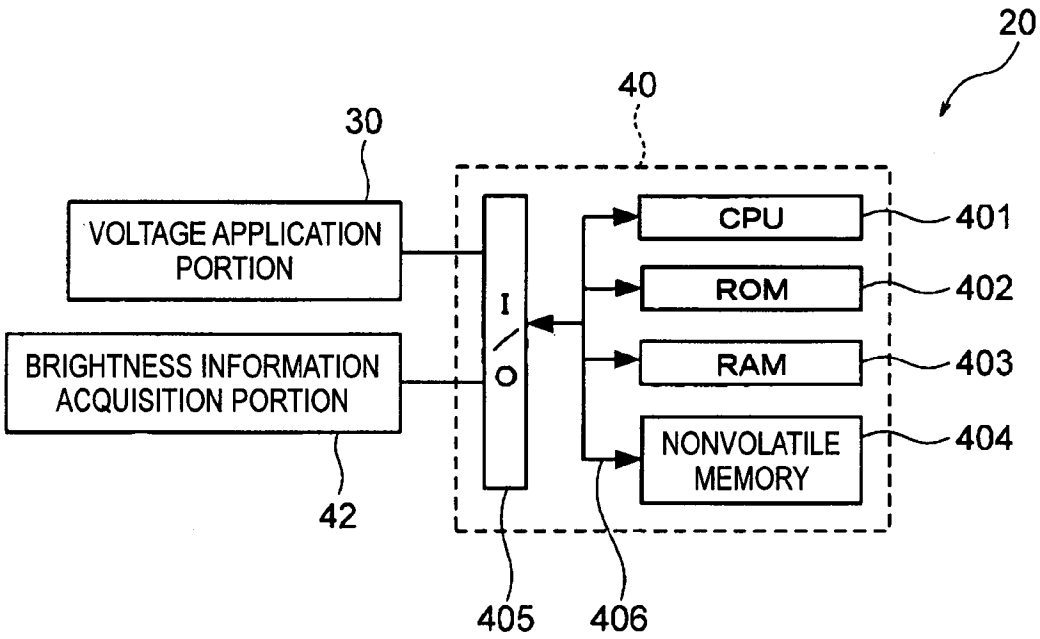
FIG. 4 is a block diagram in the case where a control portion is constituted by a computer.

As shown in FIG. 4, for example, the control portion 40 is formed as a computer 40. The computer 40 has a configuration in which a CPU (Central Processing Unit) 401, an ROM (Read Only Memory) 402, an RAM (Random Access Memory) 403, a nonvolatile memory 404, and an input/output interface (I/O) 405 are connected to one another through a bus 406. The voltage application portion 30 is connected to the computer 40 in the I/O 405. In this case, a drive program which makes the computer 40 execute a process for driving the display medium 10 as will be described later is written in advance, for example, into the nonvolatile memory 404 and the CPU 401 reads and executes the drive program. Incidentally, the drive program may be designed to be provided by a recording medium such as a CD-ROM.

The brightness information acquisition portion 42 acquires brightness information indicating brightness of irradiation beams irradiated on the display medium 10. The exemplary embodiment will be described in the case where an illuminance sensor detecting illuminance of irradiation beams irradiated on the display medium 10 is used as the brightness information acquisition portion 42 by way of example. In this case, the illuminance sensor detects illuminance (luxes) as brightness information of irradiation beams irradiated on the display medium 10. The illuminance sensor is disposed in the neighborhood of the display medium 10 so as to be able to detect the illuminance of the irradiation beams irradiated on the display medium 10.

Next, as an effect of the exemplary embodiment, control executed by the CPU 401 of the control portion 40 will be described with reference to a flow chart shown in FIG. 5.

First, in Step S10, color information of an image to be displayed on the display medium 10, that is, color information of each of respective colors, i.e. yellow, magenta and cyan is acquired from a not-shown external device, for example, through the I/O 405.

In Step S12, illuminance as brightness information detected by the brightness information acquisition portion 42 is acquired.

In Step S14, determination is made as to whether the illuminance acquired in Step S12 is at least a predetermined threshold or not. The threshold is set as a value based on which it can be determined that glare may likely occur as to a display color of a predetermined range in which glare may likely occur when the illuminance is not smaller than the threshold. Accordingly, when the illuminance is at least (not smaller than) the predetermined threshold, that is, when glare may likely occur as to the display color of the predetermined range in which glare may likely occur, the flow of processing shifts to Step S16. On the other hand, when the illuminance is smaller than the predetermined threshold, that is, when glare may unlikely occur as to the display color of the predetermined range in which glare may likely occur, the flow of processing shifts to Step S20. Incidentally, for example, white as the color of a base of the display medium 10 and a bright color close to white are also included in the display color of the predetermined range in which glare may likely occur.

In Step S16, a contrast correction process is executed on the color information (pixel values) of the three colors acquired in Step S10 based on the illuminance of the irradiation beams irradiated on the display medium 10, which illuminance is acquired in Step S12. For example, the color information of the respective colors CMY is subjected to contrast correction so that the image density increases as the detected illuminance increases. That is, the contrast correction is performed so that as the detected illuminance increases, the image density increases so as to decrease the reflection quantity of the color of the base with respect to the irradiation beams. Thus, occurrence of glare can be suppressed.

Figure 6:
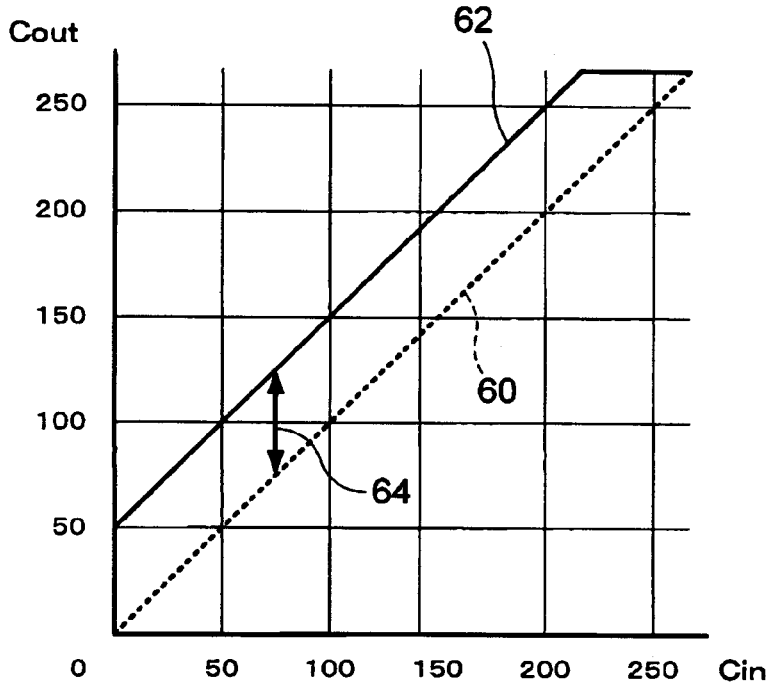
FIG. 6 is a graph showing an input/output characteristic of contrast correction.

Specifically, as shown in FIG. 6, color information of each color is corrected based on an input/output characteristic 62 which is obtained by shifting a normal input/output characteristic 60 not subjected to the contrast correction, upward as the detected illuminance increases, that is, based on an input/output characteristic 62 subjected to the correction. An example in which color information of each color is 8 bits (256 gradations) and in which the density is lower when the value is smaller and the density is higher when the value is larger is shown in FIG. 6. In addition, the normal input/output characteristic 60 is a characteristic in which color information Cin acquired in Step S10 is not corrected but outputted as color information Cout directly to the voltage application portion 30. A shift quantity 64 by which the normal input/output characteristic 60 is shifted to the input/output characteristic 62 subjected to the correction is set in advance to be larger as the illuminance acquired in Step S12 is higher. For example, a first correspondence between the illuminance and the shift quantity 64 is predetermined and the shift quantity 64 corresponding to the detected illuminance is set by use of the first correspondence. Thus, an input/output characteristic 62 subjected to the correction is set.

In the example of FIG. 6, when the color information Cin acquired in Step S10 is '50', the color information Cout is corrected to '100'. That is, correction is performed to increase the density. In this manner, correction is performed to darken the whole image containing the pixels of the display color of the predetermined range in which glare may likely occur so that glare can be suppressed without breaking the balance of the whole image. In addition, since the shift quantity 64 is not set to be always constant regardless of the illuminance but set in accordance with the illuminance, the image can be suppressed from being darkened unnecessarily.

Although the first correspondence between the illuminance and the shift quantity 64 may be set to be the same for all the colors yellow, magenta and cyan as described above, the first correspondence may be set in accordance with each color. That is, the first correspondence may be set in accordance with each color so that occurrence of glare as to the display color of the predetermined range in which glare may likely occur can be suppressed effectively.

Figure 7:
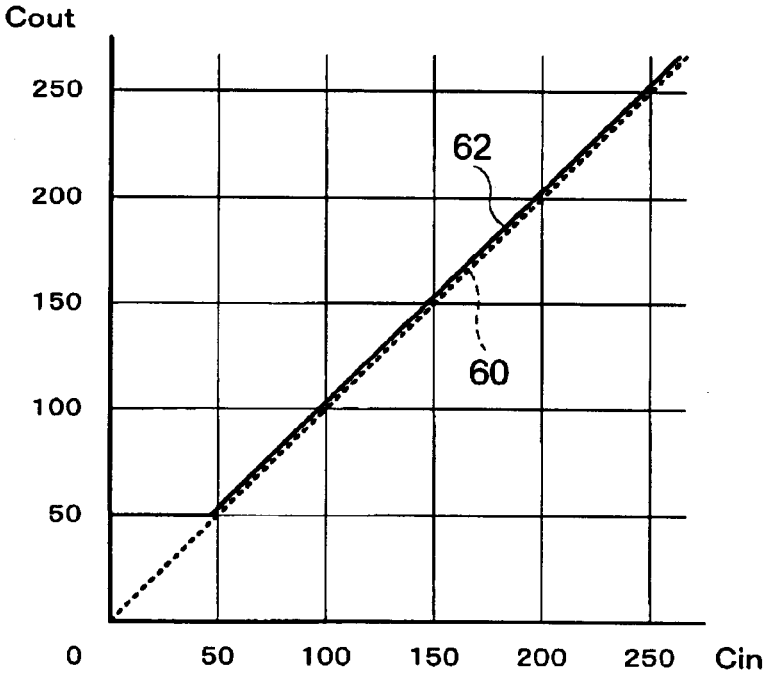
FIG. 7 is a graph showing another example of the input/output characteristic of the contrast correction.

In addition, as to the color information Cin on the low density side, color information Cout subjected to the correction may be set as a predetermined fixed value, for example, as shown in FIG. 7. Also in this case, the fixed value may be set to increase as the illuminance increases. In the example of FIG. 7, color information Cin in the range of from '0' to '49' is set as the display color of the predetermined range in which glare may likely occur so that only the color information Cin in that range is corrected to '50'. In addition, the color having color information not smaller than '50' is the same as the normal input/output characteristic 60. In this manner, only the color information of the pixels of the display color of a partial density range in which glare may likely occur is corrected. Accordingly, the whole image can be suppressed from being darkened.

In Step S18, a gamma correction process is executed on the color information (pixel values) of the three colors after the contrast correction of Step S16 based on the illuminance of the irradiation beams irradiated on the display medium 10, which illuminance is acquired in Step S12. For example, gamma correction is applied to the color information of each of the colors CMY so that the image density increases as the detected illuminance increases. That is, the gamma correction is performed so that as the detected illuminance increases, the image density increases so as to decrease the reflection quantity of the color of the base with respect to the irradiation beams. In this manner, occurrence of glare can be suppressed.

Figure 8:
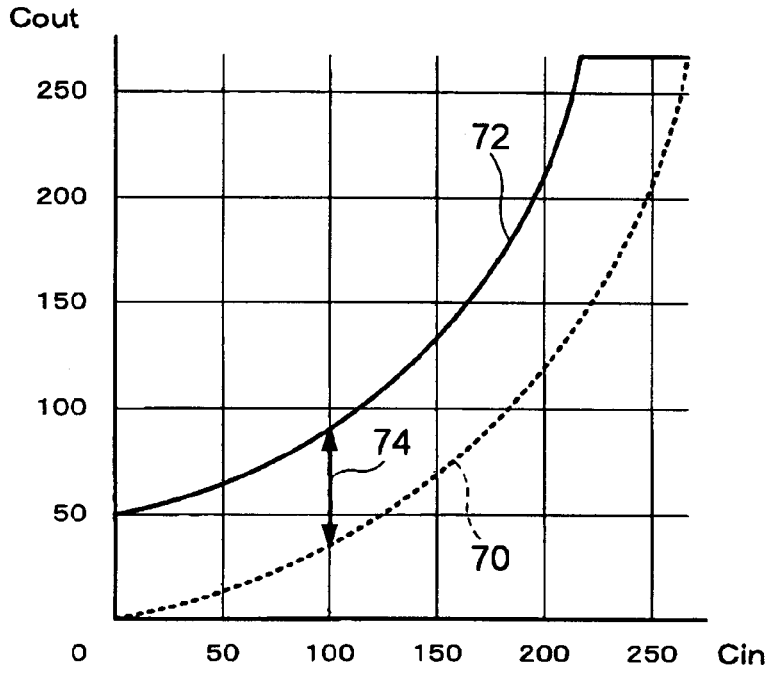
FIG. 8 is a graph showing an input/output characteristic of gamma correction.

Specifically, as shown in FIG. 8, the color information of each color is corrected based on an input/output characteristic 72 obtained by shifting a normal input/output characteristic 70 not subject to the gamma correction, upward as the detected illuminance increases, that is, based on an input/output characteristic 72 subjected to the correction. A shift quantity 74 by which the normal input/output characteristic 70 is shifted to the input/output characteristic 72 subjected to the correction is set in advance to be larger as the illuminance acquired in Step S12 is higher. For example, a second correspondence between the illuminance and the shift quantity 74 is predetermined and the shift quantity 74 corresponding to the detected illuminance is set by use of the second correspondence so that an input/output characteristic 72 subjected to the correction is set. In this manner, the correction is made to increase the density in the whole density range. Accordingly, the correction is made to darken the whole image including the pixels of the display color of the predetermined range in which glare may likely occur. Thus, glare can be suppressed without breaking the balance of the whole image. In addition, the shift quantity 74 is not set to be always constant regardless of the illuminance but set in accordance with the illuminance. Thus, the image can be suppressed from being darkened unnecessarily.

Incidentally, although the second correspondence between the illuminance and the shift quantity 74 may be set to be the same for all the colors yellow, magenta and cyan as described above, the second correspondence may be set in accordance with each color. That is, configuration may be made in such a manner that the second correspondence can be set in accordance with each color so that occurrence of glare as to the display color of the predetermined range in which glare may likely occur can be suppressed effectively.

Figure 9:
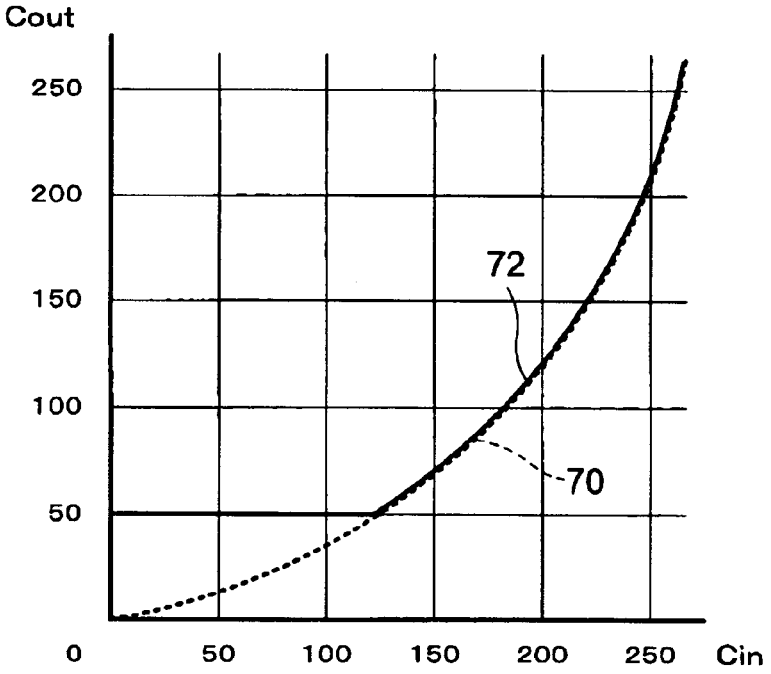
FIG. 9 is a graph showing another example of the input/output characteristic of the gamma correction.

In addition, as to the color information Cin on the low density side, color information Cout subjected to the correction may be set as a predetermined fixed value similarly to the contrast correction, for example, as shown in FIG. 9. Also in this case, the fixed value may be set to be larger as the illuminance is higher. In the example of FIG. 9, a color having color information in the range of from '0' to '124' is set as the display color of the predetermined range in which glare may likely occur so that only the color information in that range is corrected to a fixed value '50'. In addition, the color having color information not lower than '125' has the same input/output characteristic as the normal input/output characteristic 70. In this manner, only the color information of the pixels of the display color of a partial density range in which glare may likely occur is corrected so that the whole image can be suppressed from being darkened.

Incidentally, the first correspondence in the contrast correction and the second correspondence in the gamma correction are set to have an optimal combination so that occurrence of glare as to the display color of the predetermined range in which glare may likely occur can be suppressed effectively.

In the case where the contrast correction and the gamma correction have been performed in the Steps S16 and S18, the color information subjected to the corrections is outputted to the voltage application portion 30 in Step S20. When these corrections are not performed, the color information acquired in Step S10 is outputted directly to the voltage application portion 30.

In this manner, when the detected illuminance is not smaller than the threshold based on which it can be determined that glare may likely occur in the exemplary embodiment, the image density is increased in accordance with the illuminance to thereby decrease the brightness of the color in which glare occurs easily, such as white which is the color of the base. Incidentally, the brightness means brightness, for example, defined based on JIS8715, JIS8148 and ISO2470, etc.

Figure 10:
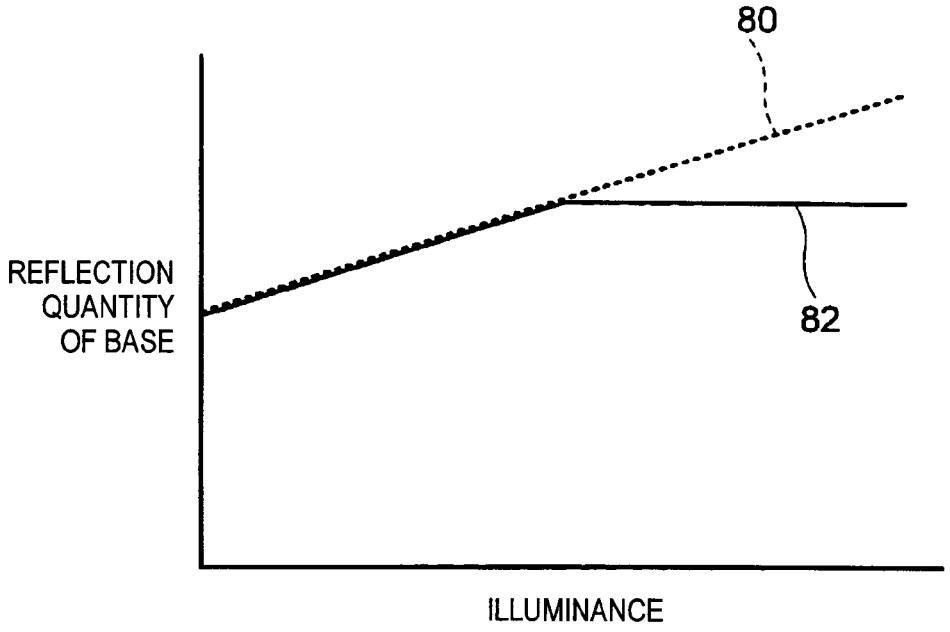
FIG. 10 is a graph showing the relation between illuminance and the reflection quantity of a base.

For example, as shown in FIG. 10, in terms of the relation between the illuminance and the reflection quantity of the white part of the base with respect to the irradiation beams, the reflection quantity of the white part of the base increases as the illuminance increases in a background-art input/output characteristic 80. On the other hand, according to the exemplary embodiment, the aforementioned contrast correction and the aforementioned gamma correction are executed to thereby form a characteristic 82 in which the reflection quantity of the white part of the base is suppressed from increasing even when the illuminance increases.

Figure 11:
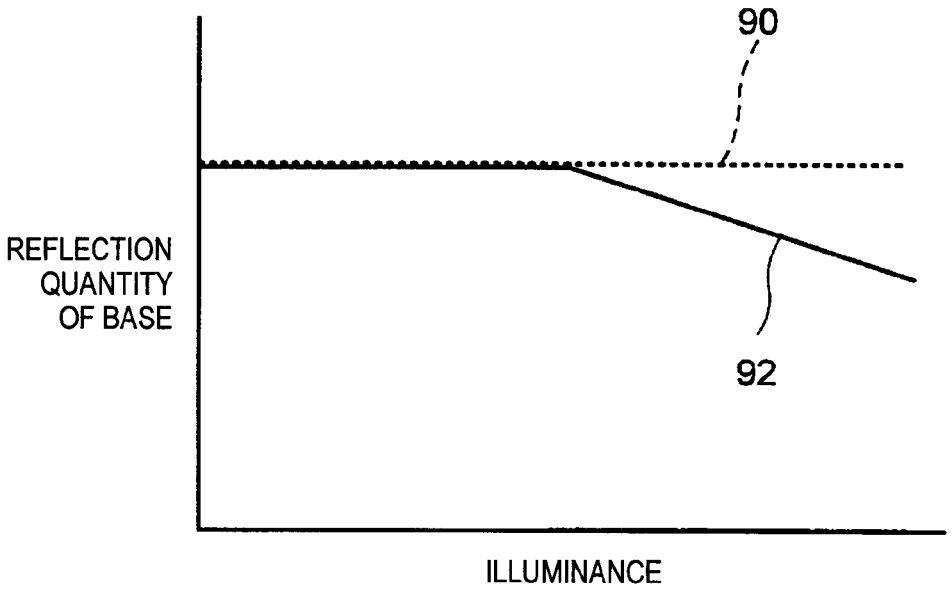
FIG. 11 is a graph showing the relation between illuminance and brightness of the base.

In addition, as shown in FIG. 11, in terms of the relation between the illuminance and the brightness of the white part of the base, the brightness is constant even when the illuminance increases in a background-art characteristic 90. On the other hand, according to the exemplary embodiment, the aforementioned process is executed to thereby form a characteristic 92 in which the brightness of the white part of the base decreases as the illuminance increases. In this manner, for example, even in an environment in which the display medium 10 is disposed under the sunlight and illuminance of irradiation beams irradiated on the display medium 10 is so high that glare may normally occur, occurrence of glare can be suppressed.

Incidentally, the exemplary embodiment has been described in the case where both the contrast correction and the gamma correction are executed. However, configuration may be made so that either of the contrast correction and the gamma correction is executed. In this case, when only the contrast correction is executed, the first correspondence is set optimally so that occurrence of glare as to the display color of the predetermined range where glare may likely occur can be suppressed effectively. When only the gamma correction is executed, the second correspondence is set optimally so that occurrence of glare as to the display color of the aforementioned range in which glare may likely occur can be suppressed effectively.

In addition, the exemplary embodiment has been described in the case where the input/output characteristic of the color information is corrected so that the contrast correction and the gamma correction are performed to suppress occurrence of glare. However, configuration may be made so that, for example, occurrence of glare can be suppressed based on an analysis result of an image displayed on the display medium 10. For example, a region of a display color of a predetermined range in which glare may likely occur, i.e. a region (for example, a background region) having an area in which glare may likely occur is extracted from the image displayed on the display medium 10, and the density of pixels in the extracted region is increased. In this manner, the image in the region having the area where glare may likely occur is darkened so that occurrence of glare can be suppressed.

In addition, although the exemplary embodiment has been described in the case where illuminance of irradiation beams is detected as brightness information, configuration may be made so that any other physical quantity indicating brightness such as the light quantity or intensity of irradiation light can be detected.

In addition, configuration may be made so that weather information can be acquired as the brightness information. In this case, for example, the brightness information acquisition portion 42 is configured to have a function of making connection to the Internet etc. to thereby acquire weather information corresponding to the place where the display medium 10 is located. The control portion 40 corrects the color information based on the acquired weather information. For example, in the case where the acquired weather is fine weather, the control portion 40 shifts the input/output characteristic 60 to the input/output characteristic 62 in the contrast correction to correct the color information, and shifts the input/output characteristic 70 to the input/output characteristic 72 in the gamma correction to correct the color information. In this manner, even in an environment in which the weather is fine and glare occurs easily, occurrence of glare can be suppressed.

Incidentally, the configuration (see FIG. 1) of the display apparatus 100 described in the exemplary embodiment is simply one example. It is a matter of course that any unnecessary part may be removed or a new part may be added without departing from the spirit and scope of the invention.

(Second Exemplary Embodiment)

A second exemplary embodiment of the invention will be described below. A display apparatus according to the second exemplary embodiment is different from the display apparatus 100 according to the first exemplary embodiment in the point that the brightness information acquisition portion 42 is configured to include a plurality of (four in FIG. 12 by way of example) illuminance sensors 42A to 42D as shown in FIG. 12.

Figure 12:
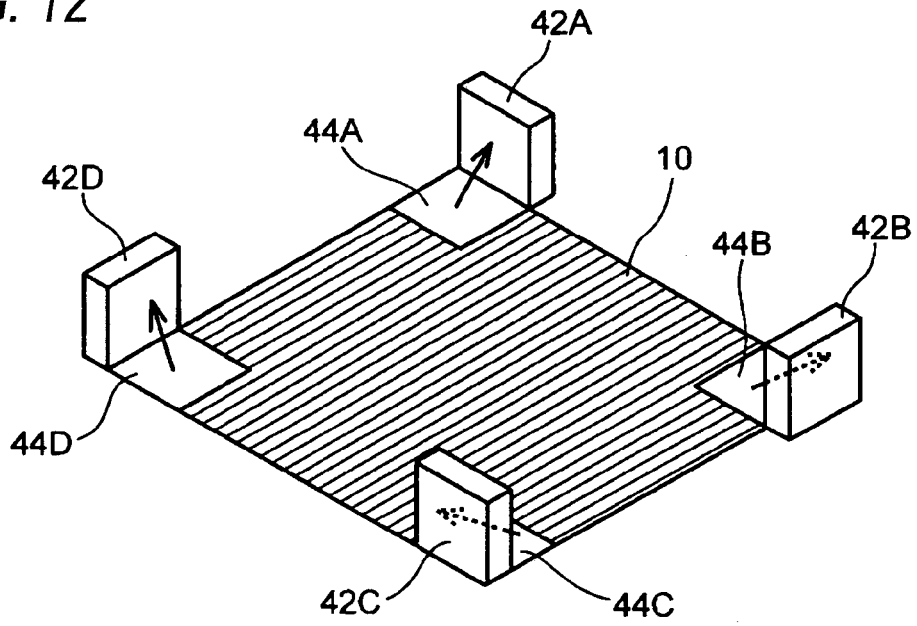
FIG. 12 is a perspective view showing the layout of illuminance sensors according to a second exemplary embodiment.

As shown in FIG. 12, the display medium 10 is formed into a tetragonal shape and the four illuminance sensors 42A to 42D are provided in four corners of the display medium 10. The illuminance sensors 42A to 42D detect reflected beams of irradiation beams irradiated on predetermined regions 44A to 44D in the four corners of the display medium 10, respectively.

Figure 13:
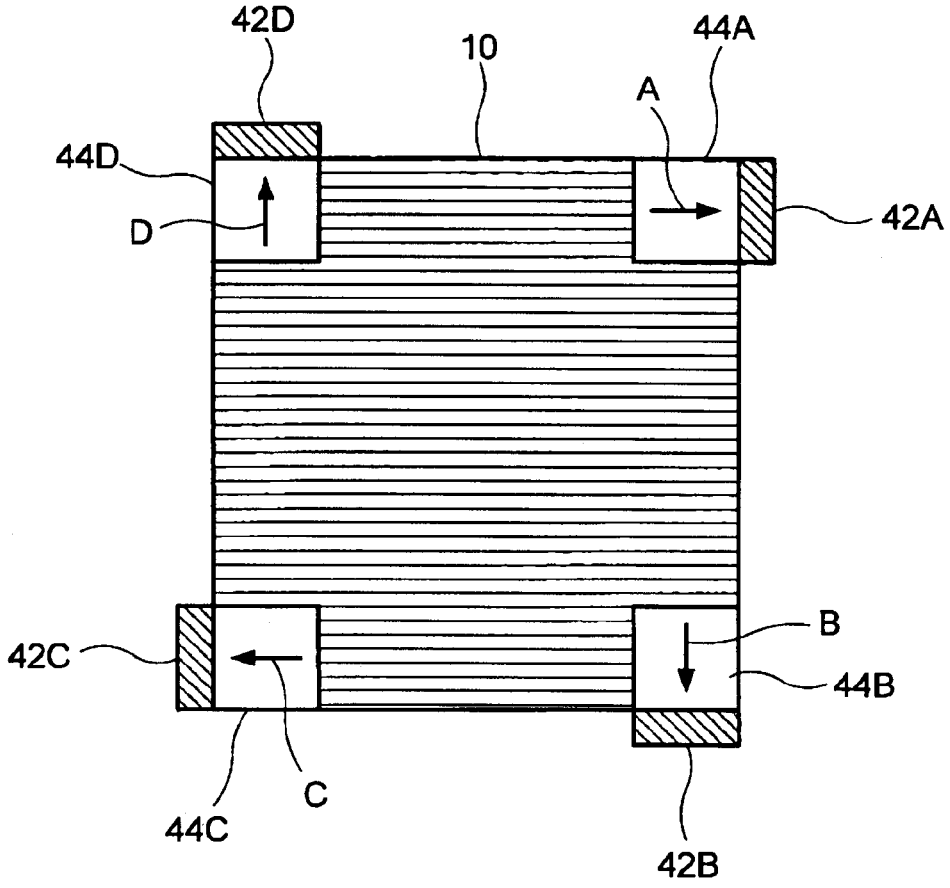
FIG. 13 is a planar view showing the layout of the illuminance sensors according to the second exemplary embodiment.

In addition, as shown in FIG. 13, the illuminance sensors 42A to 42D are disposed to have their light-receiving surfaces face in different directions from one another when the display medium 10 is viewed from above. Specifically, the illuminance sensor 42A is disposed to receive a reflected beam reflected in a direction of an arrow A, of the reflected beams of the irradiation beams irradiated on the region 44A. Similarly, the illuminance sensor 42B is disposed to receive a reflected beam reflected in a direction of an arrow B, of the reflected beams of the irradiation beams irradiated on the region 44B. The illuminance sensor 42C is disposed to receive a reflected beam reflected in a direction of an arrow C, of the reflected beams of the irradiation beams irradiated on the region 44C. The illuminance sensor 42D is disposed to receive a reflected beam reflected in a direction of an arrow D, of the reflected beams of the irradiation beams irradiated on the region 44D.

As an effect of the exemplary embodiment, control executed by the CPU 401 of the control portion 40 will be described below with reference to a flow chart shown in FIG. 14.

Figure 5:
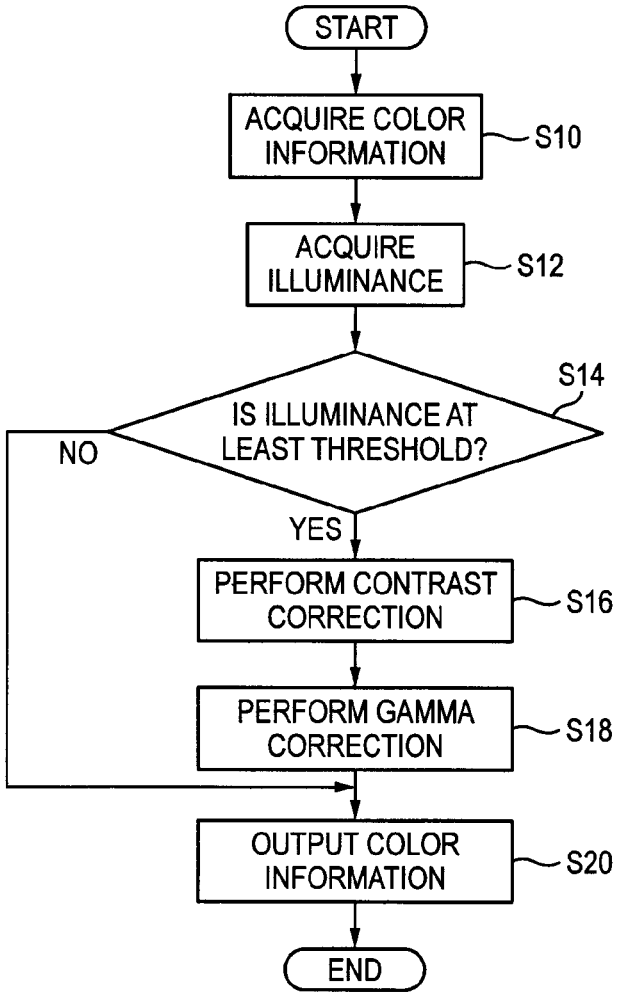
FIG. 5 is a flow chart of a process executed by the control portion.
Figure 14:
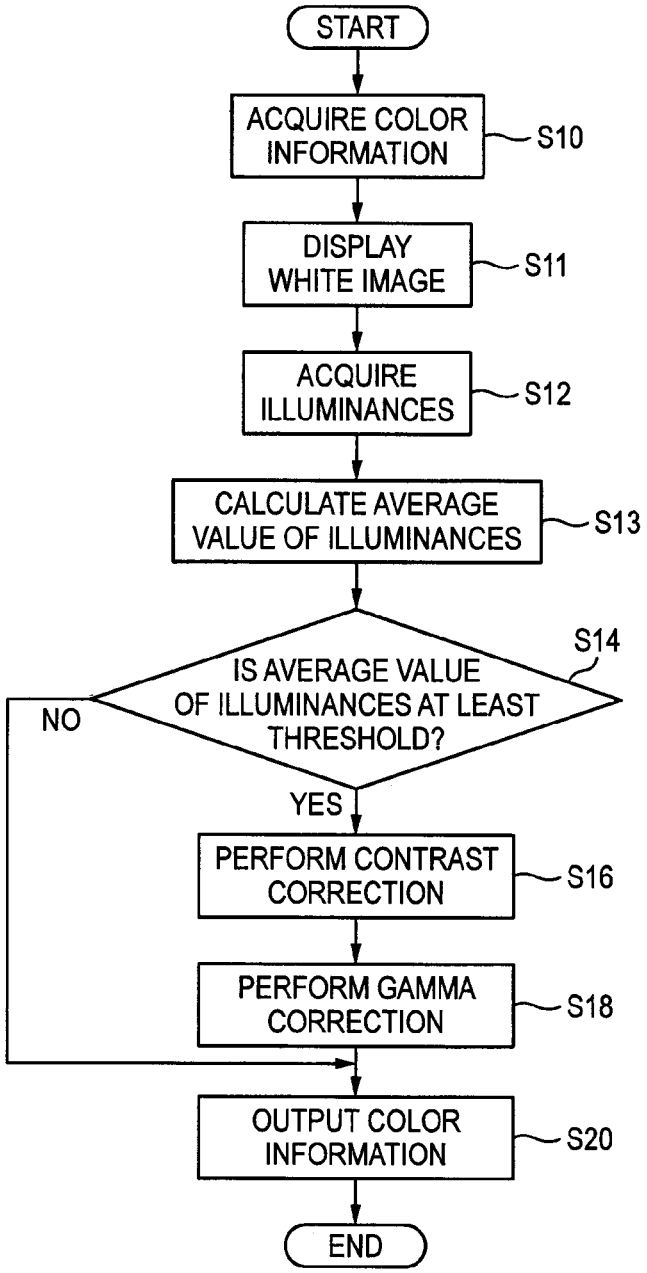
FIG. 14 is a flow chart of a process executed by the control portion according to the second exemplary embodiment.

The flow chart shown in FIG. 14 is different from the flow chart shown in FIG. 5 described in the first exemplary embodiment in the point that processes of Steps S11 and S13 are added. The different point from the flow chart shown in FIG. 5 will be mainly described as follows.

Step S10 is the same as Step S10 of the flow chart shown in FIG. 5 so that description thereof will be omitted.

In Step S11, the voltage application portion 30 is controlled so that, for example, a white image (solid image) with a density of 100% is displayed on each of the regions 44A to 44D of the display medium 10.

In Step S12, illuminances of the reflected beams of the irradiation beams irradiated on the regions 44A to 44D, which illuminances are detected by the illuminance sensors 42A to 42D are acquired respectively.

In Step S13, an average value of the illuminances of the reflected beams detected by the illuminance sensors 42A to 42D is calculated.

In Step S14, determination is made as to whether the average value of the illuminances of the reflected beams calculated in Step S13 is at least a predetermined threshold or not. Processes after Step S14 are the same as those in the first exemplary embodiment so that description thereof will be omitted.

In this manner, in the exemplary embodiment, the white images are displayed in the four corners of the display medium 10 and the illuminances of the reflected beams on the regions are directed directly by the illuminance sensors 42A to 42D so that contrast correction etc. is performed. Accordingly, occurrence of glare can be suppressed more accurately.

Further, in the exemplary embodiment, the illuminance sensors 42A to 44A detect the reflected beams from the directions different from one another and determination is made as to whether glare occurs or not based on the average value of the thus detected reflected beams. Accordingly, occurrence of glare can be suppressed accurately in comparison with the case where, for example, reflected beams in the same direction are detected.

Incidentally, although the exemplary embodiment has been described in the case where four illuminance sensors are provided, the number of illuminance sensors is not limited thereto. One to three illuminance sensors or five or more illuminance sensors may be used alternatively. In addition, the regions where the white images are displayed are also not limited to the four corners of the display medium 10. The white images may be placed in any other places as long as the places are peripheral portions of the display medium 10.

(Third Exemplary Embodiment)

A third exemplary embodiment of the invention will be described below. A display apparatus according to the third exemplary embodiment is the same as the display apparatus according to the second exemplary embodiment so that description thereof will be omitted.

As an effect of the exemplary embodiment, control executed by the CPU 401 of the control portion 40 will be described below with reference to a flow chart shown in FIG. 15.

Figure 15:
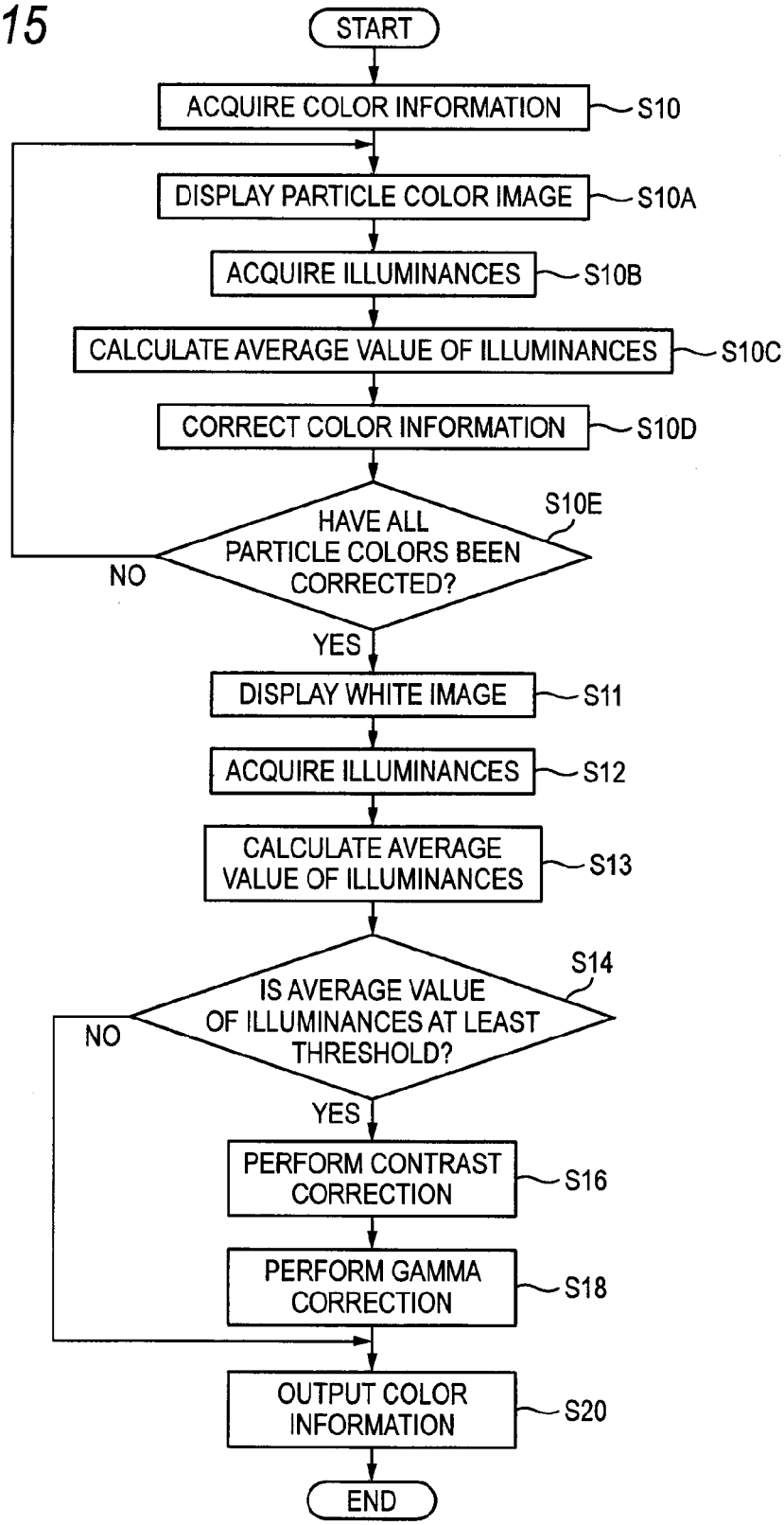
FIG. 15 is a flow chart of a process executed by the control portion according to a third exemplary embodiment.

The flow chart shown in FIG. 15 is different from the flow chart shown in FIG. 14 described in the second exemplary embodiment in the point that processes of Steps S10A to S10E are added. The different point from the flowchart shown in FIG. 14 will be mainly described as follows.

Step S10 is the same as Step S10 of the flow chart shown in FIG. 14 so that description thereof will be omitted.

In Step S10A, the voltage application portion 30 is controlled so that a particle color image (solid image) having a density 100% of a selected particle color (for example, cyan) selected from the respective particle colors CMY can be displayed on each of the regions 44A to 44D of the display medium 10.

In Step S10B, illuminances of reflected beams of irradiation beams irradiated on the regions 44A to 44D, which illuminances are detected by the illuminance sensors 42A to 42D, that is, densities of the selected particle color are acquired respectively.

In Step S10C, an average value of the illuminances of the reflected beams detected by the illuminance sensors 42A to 42D is calculated.

In Step S10D, color information of the selected particle color, of the color information acquired in Step S10 is corrected based on the average value of the illuminances of the reflected beams calculated in Step S10C. Specifically, the color information is corrected based on the average value of the illuminances of the reflected beams calculated in Step S10C, that is, a difference between the density of the selected particle color and the density of the particle color image display on each of the regions 44A to 44D. By this correction, color shift caused by the influence of the irradiation beams can be corrected.

In Step S10E, determination is made as to whether the processes of Steps S10A to S10D have been executed on all the particle colors CMY or not. When the processes of Steps S10A to S10D have been executed on all the particle colors CMY, the flow of processing shifts to Step S11. When there is an unprocessed particle color, the flow of processing returns to Step S10A so that the unprocessed particle color can be selected and the processes of Steps S10A to S10D can be executed.

In this manner, the solid images of the respective particle colors are displayed successively on the regions 44A to 44D in the four corners of the display medium 10 and the illuminances of the reflected beams on the regions 44A to 44D are detected so that densities of the respective particle colors can be detected and the color information can be corrected based on the detected densities. Accordingly, color shift caused by the influence of the irradiation beams can be suppressed.

Incidentally, even when the color information about each particle color is corrected, there may be a case where glare still occurs. To solve this problem, a process of suppressing occurrence of glare is executed in Steps S11 to S18. These processes are the same as Steps S11 to S18 in FIG. 14 so that description thereof will be omitted. In addition, when occurrence of glare can be suppressed by correction of the color information of each particle color, the processes of Steps S11 to S18 may be removed.

Incidentally, although the exemplary embodiment has been described in the case where CMY solid images are displayed successively on the regions 44A to 44D and illuminances of reflected beams on the regions 44A to 44D are detected respectively, each of the regions 44A to 44D may be split into three regions and CMY solid images may be displayed simultaneously on these three split regions. In this case, configuration may be made so that illuminance sensors each having spectral sensitivity for the colors CMY are provided in the regions 44A to 44D respectively so as to detect illuminances of reflected beams on the regions 44A to 44D. In this case, as each of the illuminance sensors provided in the regions 44A to 44D, three illuminance sensors for the colors CMY may be provided or one single illuminance sensor which has sensitivity for all the colors CMY and which can detect illuminances of reflected beams of all the colors simultaneously may be used. When configuration is made thus, it is not necessary to display CMY solid images successively but the CMY solid images can be displayed simultaneously. Accordingly, the processing time can be shortened.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A drive device for a display medium, comprising:

a control unit that controls density of a display color of a predetermined range in which glare may likely occur, of display colors of an image displayed on a reflective type display medium, based on brightness information indicating brightness of irradiation beams irradiated on the display medium so that occurrence of the glare as to the display color of the predetermined range can be suppressed;

wherein the reflective type display medium is an electrophoretic type display medium provided with a pair of substrates, a dispersion medium which is sealed between the pair of substrates, and particle groups which are dispersed in the dispersion medium and sealed between the pair of substrates so as to be able to move between the substrates in accordance an electric field formed between the substrates;

the display medium includes a plurality of particle groups with different colors; and the control unit displays images of the colors of the plurality of particle groups on at least a predetermined partial region of the display medium and the brightness information indicating the brightness is illuminances of reflected beams detected successively by an illuminance sensor provided for detecting the reflected beams of the irradiation beams irradiated on the region.

2. A drive device for a display medium, comprising:

a control unit that controls density of a display color of a predetermined range in which glare may likely occur, of display colors of an image displayed on a reflective type display medium, based on brightness information indicating brightness of irradiation beams irradiated on the display medium so that occurrence of the glare as to the display color of the predetermined range can be suppressed;

wherein the reflective type display medium is an electrophoretic type display medium provided with a pair of substrates, a dispersion medium which is sealed between the pair of substrates, and particle groups which are dispersed in the dispersion medium and sealed between the pair of substrates so as to be able to move between the substrates in accordance an electric field formed between the substrates;

the display medium includes a plurality of particle groups with different colors; and the control unit displays images of the colors of the plurality of particle groups in at least a predetermined partial region of the display medium and the brightness information indicating the brightness is illuminances of a plurality of reflected beams detected respectively by illuminance sensors having spectral sensitivity respectively for the colors of the plurality of particle groups, of reflected beams of the irradiation beams irradiated on the region.

* * * * *